US006096355A

United States Patent [19]

Lesellier et al.

[11] Patent Number: 6,096,355

[45] Date of Patent: Aug. 1, 2000

[54] METHOD OF MEASURING OUT AND/OR FORMING FOODSTUFFS, FOODSTUFFS OBTAINED BY SAID METHOD, AND PACKAGING SUITABLE FOR BEING IMPLEMENTED BY SAID METHOD

[75] Inventors: Philippe Lesellier, Tilly sur Seulles; Jean-Luc Bigot, Bayeux, both of France

[73] Assignee: Neptune S.A., Cedex, France

[21] Appl. No.: 09/008,600

[22] Filed: Jan. 16, 1998

[30] Foreign Application Priority Data

Jan. 20, 1997 [FR] France ..... 97 00549

[51] Int. Cl.[7] ..... A21D 10/02; B65B 55/00

[52] U.S. Cl. ..... 426/129; 426/396; 426/402; 426/404; 426/411; 426/412; 426/414

[58] Field of Search ..... 426/396, 402, 426/404, 411, 412, 414, 513, 129

[56] References Cited

U.S. PATENT DOCUMENTS

| | | | |
|---|---|---|---|
| 2,024,809 | 12/1935 | Schell | 99/11 |
| 2,840,121 | 6/1958 | Carruthers | 141/164 |
| 3,408,926 | 11/1968 | Rogerson | 100/49 |
| 3,574,642 | 4/1971 | Weinke | 426/413 |
| 3,736,153 | 5/1973 | Spears | 99/188 |
| 4,560,567 | 12/1985 | Rausing | 426/399 |
| 4,948,620 | 8/1990 | Clairouin et al. | 426/643 |
| 5,188,854 | 2/1993 | Hartman et al. | 426/272 |

FOREIGN PATENT DOCUMENTS

| | | |
|---|---|---|
| 2 093 205 | 1/1972 | France . |
| 1058179 | 2/1967 | United Kingdom . |
| 1063858 | 3/1967 | United Kingdom . |

*Primary Examiner*—Nina Bhat
*Attorney, Agent, or Firm*—Morgan, Lewis & Bockius LLP

[57] ABSTRACT

A method of measuring out and/or forming foodstuffs to impart a shape to the foodstuff with compromising the rheological and organoleptic properties, foodstuffs formed by this method, and packaging for foodstuffs formed by the method of the invention. In one embodiment of the invention, a foodstuff comprising fish flesh is measured into a receptacle which is sufficiently rigid to impart a desired shape to the foodstuff. In a preferred embodiment, the foodstuff comprises fish flesh, in particular the flesh of fish proper and/or of shellfish.

15 Claims, 3 Drawing Sheets

METHOD OF MEASURING OUT AND/OR FORMING FOODSTUFFS, FOODSTUFFS OBTAINED BY SAID METHOD, AND PACKAGING SUITABLE FOR BEING IMPLEMENTED BY SAID METHOD

The present invention relates to a method of measuring out and/or forming foodstuffs, in particular those based on fish flesh (i.e. the flesh of fish proper and/or of shellfish), to the foodstuff obtained by said method, and to packaging suitable for being implemented by said method.

BACKGROUND OF THE INVENTION

It is known to form or shape foodstuffs. Nevertheless, no presently known process can be used to impart the shape of a natural piece of fish to a fish-based foodstuff without compromising its rheological and organoleptic qualities.

OBJECTS AND SUMMARY OF THE INVENTION

Consequently an object of the present invention is to provide a method of measuring out a foodstuff based on fish flesh that does not deteriorate the rheological and organoleptic qualities of the foodstuff.

It is also an object of the present invention to provide a foodstuff based on fish flesh that is of a special shape, in particular a shape reminiscent of the natural shape of a piece of fish or of shellfish, or a fancy shape.

Another object of the present invention is to provide a foodstuff having a long shelf life.

Another object of the present invention is to provide an industrial method of preparing foodstuff based on fish flesh, and that is of low cost.

Another object of the present invention is to provide a foodstuff that keeps under refrigeration, and a deep frozen foodstuff.

These objects are achieved by a method of the present invention of measuring out a foodstuff based on fish flesh into a receptacle which, while the product is being placed therein, is sufficiently rigid to impart the desired shape to the foodstuff.

Advantageously, the receptacle constitutes packaging for the foodstuff. Hermetic sealing, in particular by means of a capsule on a small tray, enables the foodstuff of the present invention to keep for a long time.

Measuring out is advantageously performed at low pressure so as to avoid compromising the rheological and organoleptic qualities of the foodstuff.

Advantageously, the foodstuff is measured out at constant weight so as to obtain a standardized industrial product.

The invention mainly provides a method of forming and/or measuring out a foodstuff, the method comprising a step of applying a foodstuff based on fish flesh against the walls of a forming receptacle with sufficient force to impart the shape of the receptacle to the foodstuff but without reaching force values that would destroy the structure of the fish flesh.

The invention also provides a method wherein the forming receptacle constitutes the packaging for the foodstuff.

The invention also provides a method wherein the forming receptacle is a tray that is disposable after use.

The invention also provides a method wherein the forming is performed at constant weight of foodstuff.

The invention also provides a method including the steps consisting in:

a) placing a measured quantity of foodstuff in packaging;

b) hermetically sealing the packaging under a vacuum using a film that is more flexible than the walls of the packaging; and c) exposing the hermetically sealed packaging to atmospheric pressure so that under the action of said pressure the sealing film deforms and transmits the forces to the foodstuff for pressing it against the inside walls of the packaging.

The invention also provides a method wherein the formed and/or measured out foodstuff is based on fish flesh, with water-retaining compounds, in particular hydrocolloids, being incorporated in the mass thereof substantially uniformly.

The invention also provides a method wherein the forming receptacle, in particular the packaging, is in the shape of a piece of fish, in particular in the shape of a fillet or a steak.

The invention also provides a method wherein the packaging bears the imprint of the surface shape of a piece of fish or of shellfish.

The invention also provides a foodstuff measured out and/or shaped by a method of the invention.

The invention also provides packaging for foodstuff based on fish flesh, for implementing the method of the invention, and wherein said packaging comprises a tray that is disposable after use and that has sealing edges, and a hermetic sealing film that is more flexible than the walls of said tray.

The invention also provides packaging in the shape of a piece of fish or of shellfish.

The invention also provides packaging including the imprint of the surface of the piece of fish or of shellfish.

BRIEF DESCRIPTION OF THE DRAWINGS

The invention will be better understood from the following description and the accompanying figures, given as non-limiting examples, and in which:

In FIGS. 1 to 3, the same references are used to designate the same elements.

MORE DETAILED DESCRIPTION

Figure 1:
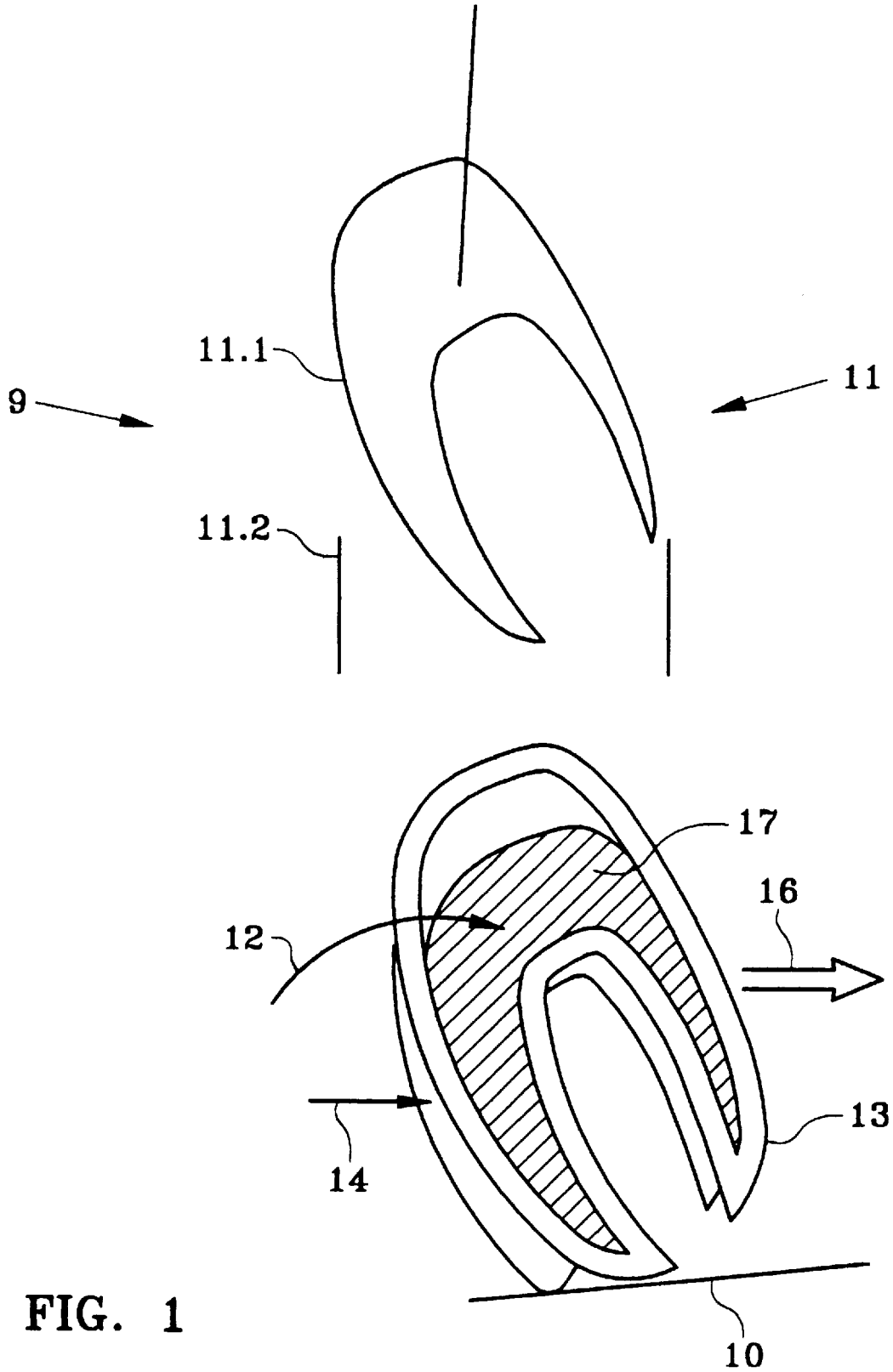
FIG. 1 is a diagram showing the forming of the present invention.

In FIG. 1, there can be seen a forming machine 9 comprising a support 10 for a forming receptacle 13, forming means 11, and means 12 for feeding the foodstuff to be formed.

Advantageously, the forming receptacle 13 is packaging for the foodstuff, the forming machine further including means 14 for feeding the packaging 13 and means 16 for removing filled packages.

By way of example, the forming means 11 comprise a piston 11.1 optionally together with a part of complementary shape.

In a first variant embodiment, the receptacle 13 is of sufficient rigidity to enable the foodstuff to be given the desired shape.

In a variant, the support 10 is of the same shape as the packaging 13 so as to support it during the forming operation, thereby preventing it from deforming when the foodstuff 12 is inserted therein.

Advantageously, forming is performed at low pressure, e.g. at a pressure of 345,000 Pa, so as to avoid tearing the fish flesh, which would destroy the fiber structure of the foodstuff. The piston 11.1 forces the foodstuff into packaging 13. Advantageously, the packaging 13 has the same shape as a piece of fish, for example a fillet or a steak, or it has the shape of a piece of shellfish. In a variant, the support 13, in particular a small tray, has a fancy shape. For example, for seafood, the tray may be in the shape of a lighthouse, of a starfish, of a shell, of a boat, etc. Advantageously, the walls of the packaging 13 have irregularities 17 analogous to those present on the piece of fish or of shellfish that is to be reproduced. These irregularities are imprinted on the foodstuff of the present invention. By way of example, the packaging 13 can be constituted by trays of polypropylene or of poly(ethylene vinyl alcohol) (EVOH). Thus, during forming, the textured mass of fish flesh is agglomerated so as to give it the shape of a piece, in particular a fillet or, as shown, a steak. Advantageously, forming is performed at constant weight, with the exact shape being conferred by the shape of the packaging 13.

Advantageously, the packaging 13 receives a hermetic sealing capsule 15.

Figure 2:
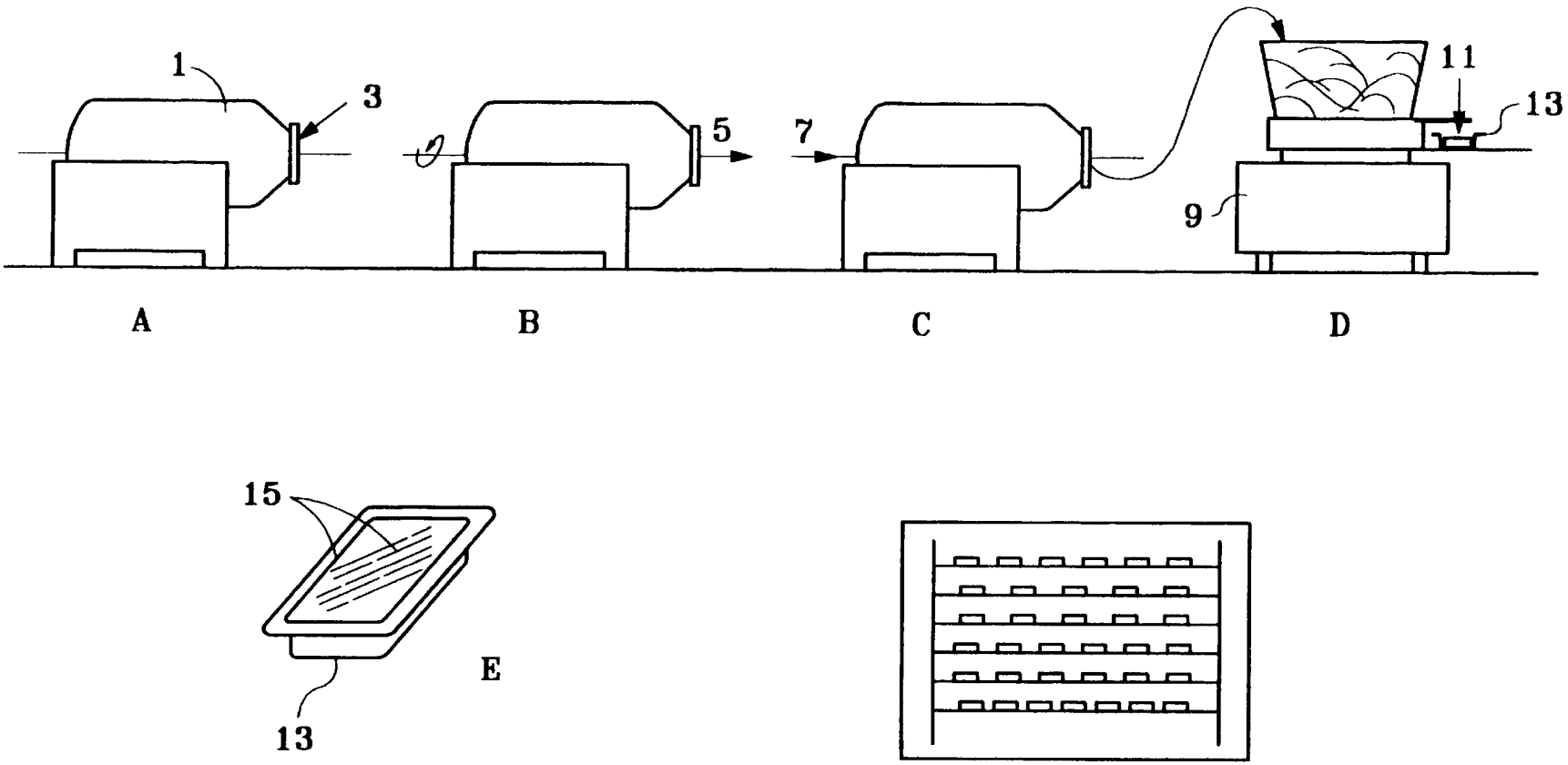
FIG. 2 is an overview of the manufacture of a foodstuff in accordance with the present invention.

In the variant shown at D in FIG. 2, the foodstuff of the invention is advantageously measured out at low pressure and/or at constant weight. The desired quantity of foodstuff is sucked into a stuffing cavity before being transferred into an opening formed through a plate in order to be pushed, e.g. by means of a piston, into the empty tray 13. The filled tray is vacuum-sealed using a flexible film 15 that provides a hermetic seal.

The walls of the tray are considerably more rigid than is the film. Thus, when the closed tray is subjected to atmospheric pressure, the film deforms considerably and applies forces to the foodstuff that are directed towards the inside walls of the tray. The foodstuff of the invention based on fish flesh takes on the shape of the tray which imparts any irregularities or patterns 17 it may have to the surface of the foodstuff, thereby reproducing the shape or imitating the surface of a real piece of fish or of shellfish.

In a variant, during shaping or measuring out, there are placed in the container 13, not only the mass of textured fish flesh, but also garnishing. The garnishing can be placed on the bottom of the tray, on the top of the tray, or on at least one of its sides.

After the packaging 13 has been hermetically sealed, the foodstuff 12 is advantageously cooked, e.g. in an autoclave, by steam cooking, etc.

The vacuum packing of the foodstuff prevents it from losing water during cooking. By way of example, cooking can be performed for a duration lying in the range ½ hour (h) to 4 h, and preferably in the range 1 h to 3 h, at a temperature lying in the range 50° C. to 100° C., preferably in the range 70° C. to 90° C., e.g. 75° C., at a pressure lying in the range 0 to $4\times10^5$ Pa, e.g. equal to $2\times10^5$ Pa. In a variant, the cooking step is replaced by texturing at high pressure, e.g. lying in the range $2\times10^8$ Pa to $4\times10^8$ Pa, by decontamination using ionizing radiation, and/or by deep freezing.

The method of the present invention is particularly adapted to measuring out and packaging foodstuffs based on fish flesh without irreversible spoiling the fibre structure of the flesh, in particular without physical breakage. This spoiling that is to be avoided consists in lumps of flesh being broken up to very small dimensions that do not impart the desired organoleptic qualities to the foodstuff, and/or in damage to the fibers forming each lump.

Water loss can be avoided or limited by incorporating edible water-retaining compounds in the flesh, in particular hydrocolloids.

By way of example, a foodstuff 12 can be obtained which is formed in the support 13 by mechanically mixing and/or kneading fish flesh, i.e. by performing mixing or kneading that avoids significant irreversible spoiling of the fiber structure of the flesh, and doing so in the presence of edible water-retaining compounds, in particular edible hydrocolloids. Mixing and/or kneading is continued until a uniform concentration of water-retaining compounds together with possible other additives is obtained throughout the mass of fish flesh.

The rate at which water-retaining compound(s), cohesion agents, and other additives diffuse through the mass of fish flesh to be treated is slowed down by the large size of the lumps of flesh, by the compact structure of the flesh which the method of the invention seeks to preserve, by the lack of violent mechanical stirring, and by processing at a low temperature which favors conservation of the treated flesh by limiting any multiplication of microbes. To achieve acceptable diffusion times, mechanical means are implemented globally or locally for performing stirring, mixing, and/or kneading, without imparting stresses to the flesh to be processed that are liable to damage its structure. Uniform distribution of water-retaining compounds throughout the mass of flesh improves the organoleptic qualities of the resulting foodstuff because water losses are reduced. Thus, a treated product is subject to less than 2% exuded fluid loss whereas a non-treated product is subjected to more than 15%.

In FIG. 2, there can be seen the preferred implementation of the method of the present invention.

At A, the ingredients are inserted into a device that accelerates penetration of water-retaining compounds, and advantageously into a horizontal-axis churner 1. In a variant, use is made of mixers, stirrers, homogenizers, or of any other devices that perform mechanical mixing without imparting stresses to the flesh that are liable to deteriorate its fiber structure. It is also possible to use devices, in particular piezoelectric devices that generate sound, ultrasound, or infrasound vibration in the mixture to be processed including at least the fish flesh together with a water-retaining compound, in particular a hydrocolloid. It also possible to insert stabilizers, coloring agents, flavoring, water, oils, etc. Advantageously, the fish flesh is inserted at a temperature lying in the range −10° C. to +10° C., preferably lying in the range −5° C. to +2° C., for example equal to −1° C., −0.5° C., or 0° C. At temperatures below −5° C., the fish flesh tends to harden, and that is to be avoided. Nevertheless, it is also possible to insert deep frozen fish into the churner, with the temperature of the fish flesh increasing due to heating and/or due to the mixing performed. In contrast, above 10° C., the fish flesh runs the risk of suffering bacteriological deterioration and water loss.

The door 3 of the churner is closed hermetically.

Advantageously, the churner 1 includes means for adjusting its speed of rotation that enable a very low speed of rotation to be selected, less than one revolution per minute (rpm), e.g. equal to 0.2 rpm, or advantageously 0.1 rpm.

At B, as symbolized by arrow 5, the internal pressure that obtains inside the churner is reduced.

Surprisingly, to obtain a firm foodstuff based fish flesh, i.e. a foodstuff in which the myotomes of the fish flesh are closed, it is advantageous to establish a partial vacuum inside the churner, thereby causing the myotomes to open temporarily and thus favoring penetration of additives, and in particular of hydrocolloids, into the fish flesh. Nevertheless, the pressure inside the churner is preferably sufficient to ensure that opening of the myotomes is reversible on returning to atmospheric pressure. Improved results have been obtained when the pressure inside the churner lies in the range $0.45\times10^5$ Pa to $0.65\times10^5$ Pa.

It is also possible to add surimi, fish proteins, cheese, herbs, onions, vegetables, garnishing, or sugars. Churning, i.e. rotation of the churner, lasts for a time lying in the range ¼ h to 5 h, advantageously in the 1 h to 3 h, e.g. 2 h.

The speed of rotation must decrease with increasing diameter of the churner. The churner may be rotated continuously in a single direction or it may be rotated in a succession of rotation cycles either in one direction only or including reversals of direction of rotation. Churning causes the additives to penetrate into the fish flesh, thereby enabling the foodstuff to be homogenized.

As a function of ambient temperature and of the energy given to the mass during churning, in particular by rotation of the churner 1, it may be advantageous to cool the contents of the churner. In the example shown at C, arrow 7 represents insertion of nitrogen taken from a liquid nitrogen source.

At D, the forming and measuring out of the invention are performed.

At E, the tray 13 is sealed with the capsule 15.

At F, the shaped and packaged foodstuff is cooked.

Figure 3:
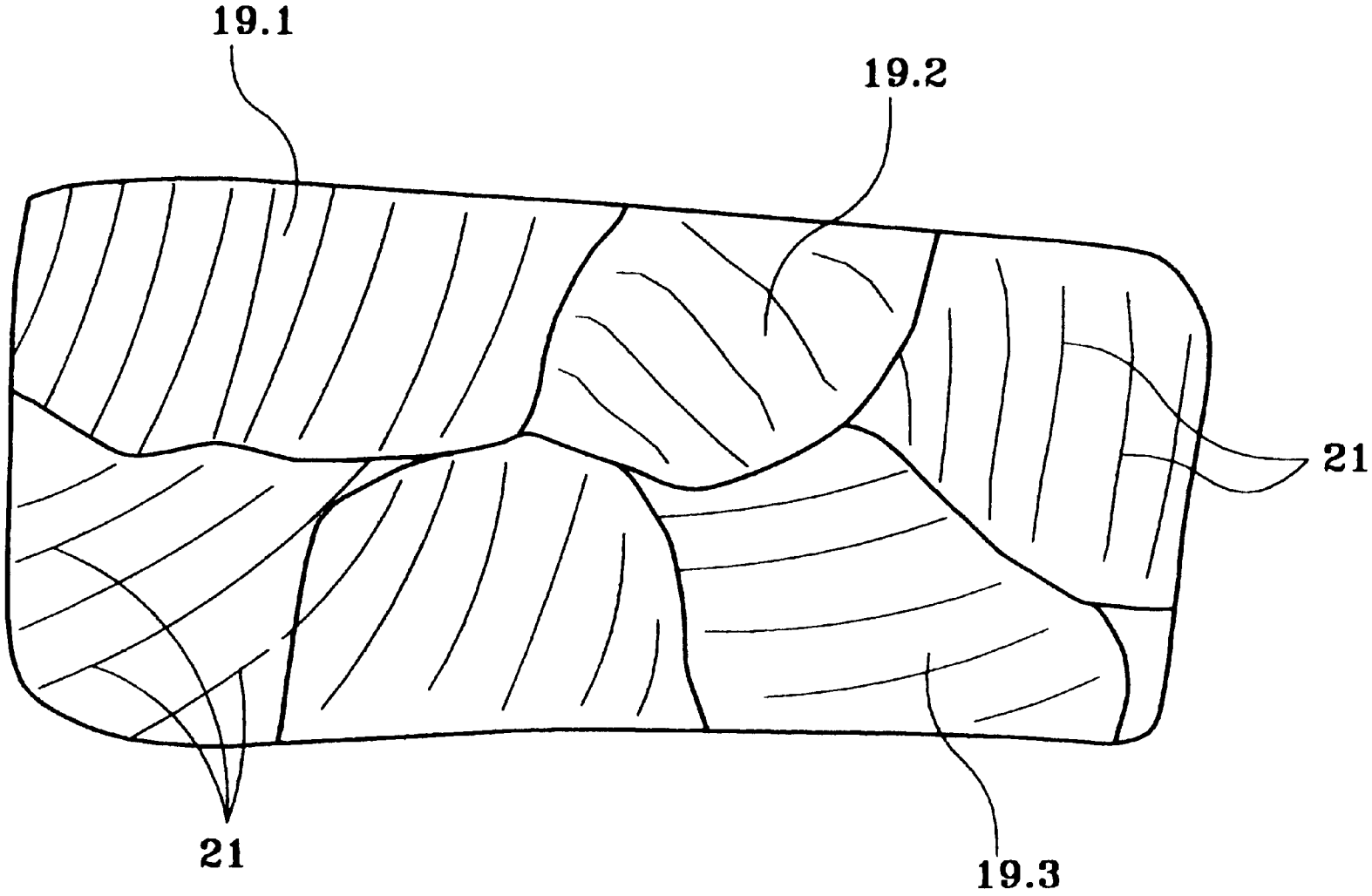
FIG. 3 is a diagram showing the structure of the preferred implementation of the foodstuff of the present invention.

FIG. 3 shows an example of a reconstituted fish fillet of the present invention. The fillet 19 comprises a Juxtaposition of lumps 19.1, 19.2, and 19.3 of fish without the myotomes 21 being disorganized. The dimensions of the lumps 19 lie in the range 1 cm to 6 cm, preferably in the range 2 cm to 4 cm, e.g. being equal to 2 cm or 3 cm. The reconstituted fillet is made up of at least 80% of lumps having this size.

The packaged food product commonly has a shelf life of 45 days to 60 days when refrigerated (temperature below 5° C.).

In a variant, the foodstuff of the present invention may be deep frozen after step D, E, or F for conservation and/or commercialization purposes.

There follow several non-limiting examples of formulations that can be implemented by the method of the present invention. Percentages are percentages by weight.

EXAMPLE 1

A fillet of fresh whiting plus (0.5%) polyphosphates and 0.2% carrageenans were placed in a double-walled mixer. Mixing was performed at low speed. The temperature of the mixture was maintained below 5° C. by a flow of ice water through the double wall. 100 grams (g) of mixture were then thrust into a fillet-shaped mold which was then vacuum-closed and placed in an autoclave, with its temperature rising to 80° C. over 5 minutes and being maintained at 80° C. for 1 hour. After cooling, the amount of liquid exuded was measured and compared with the amount of liquid exuded from a mixture that had been subjected to the same process but without any water-retaining agents:

| Process | Liquid exuded on the same day (in %) | Liquid exuded after storage for 10 days at 4° C. (in %) |
|---|---|---|
| without additives | 10.5 | 14 |
| with additives (polyphosphates + carrageenins) | 0.34 | 2.5 |

EXAMPLE 2

A series of experiments was performed on frozen salmon together with 0.3% polyphosphates and 0.3% carrageenans. The mixer used was a Stephan type mixer without thermostatic control, including equipment for making a vacuum and modified to operate at very low speed. The energy provided was necessary and sufficient for unfreezing the fillet of salmon during the operation, and the total duration of the process was sufficiently short to ensure that the fish did not heat up to more than 4° C.

The first test consisted in performing the mixing operation at atmospheric pressure. In the second test, a partial vacuum ($8\times10^4$ Pa) was implemented throughout the mixing operation. After mixing, the resulting mixture was molded in the form of a salmon steak, the container was then sealed and subjected to heat treatment in a steam tunnel: for 10 minutes in a module at 80° C. or for 35 minutes in a module at 75° C. After cooling, the amounts exuded were evaluated as in Example 1:

| Process | Liquid exuded on the same day (in %) | Liquid exuded after storage for 10 days at 4° C. (in %) |
|---|---|---|
| atmospheric pressure | 1.70 | 5 |
| partial vacuum | 1.25 | 3 |

Mixing under a vacuum provides a moderate improvement in the water-retention qualities of the mixture treated in this way.

EXAMPLE 3

Fillets of fresh cod were inserted into a churner together with a mixture of polyphosphates, carob-bean, and salt.

Mixing took place at a low speed of rotation for 5 minutes.

Crushed ice and water were added to keep the temperature of the mixture at around 0° C.

100 g portions were measured out into a composite card/polyester package (capable of withstanding high temperature) that was vacuum-sealed and subjected to cooking-pasteurization processing in a microwave tunnel so as to achieve a core temperature of 80° C. The resulting product had a shelf life of 60 days when refrigerated (temperature less than +5° C.) and there was no modification to the organoleptic properties and there was no significant fluid loss from the fillet.

Naturally, the method of the present invention for measuring out and/or forming fish flesh can also be implemented on other foodstuffs without going beyond the ambit of the present invention.

The present invention applies particularly to the food industry.

The present invention applies mainly to processing fish proper, as distinct from shellfish.

What is claimed is:

1. A method of forming a foodstuff, comprising the steps of:

placing a measured quantity of a foodstuff comprising fish flesh in a receptacle, wherein the receptacle comprises walls having sufficient rigidity to impart a shape to the foodstuff;

placing a film over the receptacle, wherein the film is more flexible than the walls of the receptacle;

hermetically sealing the receptacle with the film wider a vacuum to form a sealed film; and applying force to the sealed film, wherein the foodstuff is pressed against the walls of the receptacle, wherein the shape of the receptacle is imparted to the foodstuff, and wherein the structure of the foodstuff is substantially maintained.

2. A method of claim 1, wherein the receptacle is used as a packaging for the foodstuff.

3. A method of claim 1, wherein the step of applying force comprises:

exposing the hermetically sealed receptacle to atmospheric pressure, wherein the atmospheric pressure deforms the sealed film and presses the foodstuff against the walls of the receptacle.

4. A method of claim 1, wherein the foodstuff comprising fish flesh ether comprises water-retaining compounds, and wherein the water-retaining compounds are incorporated uniformly throughout the foodstuff.

5. A method of claim 4, wherein the receptacle is used as a packaging, and the receptacle bears the imprint of a shape selected from: a surface of a piece of fish or a surface of a shellfish.

6. A method of claim 4, wherein the water-retaining compounds are hydrocolloids.

7. A method of claim 6, wherein the receptacle is used as a packaging, and the receptacle bears the imprint of a shape selected from: a surface of a piece of fish or a surface of a shellfish.

8. A method of claim 1, wherein the receptacle has the shape of a piece of fish.

9. A method of claim 8, wherein the receptacle has a shape selected from: a shape of a fillet or a shape of a steak.

10. A foodstuff formed by a method of claim 1.

11. A packaging for a foodstuff wherein the foodstuff comprises fish flesh, and wherein the packaging comprises a film and a tray that are disposable after use, wherein the tray has edges capable of forming a hermetic seal with the film, and wherein the film is more flexible than the walls of the tray such that when a force is applied to a foodstuff contained within the sealed tray the foodstuff is pressed against the walls of the tray, wherein the shape of the tray is imparted to the foodstuff, and wherein the structure of the foodstuff is substantially maintained.

12. A packaging of claim 11, wherein the shape of the packaging is selected from: a shape of a piece of fish or a shape of a shellfish.

13. A packaging of claim 12, wherein the packaging bears the imprint of a shape selected from: the surface of a piece of fish or the surface of a shellfish.

14. A method of forming a foodstuff, comprising the steps of:

placing a measured quantity of a foodstuff comprising fish flesh in a receptacle, wherein the receptacle comprises walls having sufficient rigidity to impart a shape to the foodstuff;

placing a film over the receptacle, wherein the film is more flexible than the walls of the receptacle;

hermetically sealing the receptacle with the film under a vacuum to form a sealed film;

exposing the hermetically sealed receptacle to atmospheric pressure, wherein the atmospheric pressure deforms the sealed film and presses the foodstuff against the walls of the receptacle; and using the hermetically sealed receptacle as a packaging for the foodstuff.

15. A foodstuff formed by a method of claim 14.

* * * * *